US005961202A

United States Patent [19]

Lin

[11] Patent Number: 5,961,202

[45] Date of Patent: Oct. 5, 1999

[54] STRUCTURE OF A DECORATIVE BOARD ASSOCIATED WITH MINIATURE CHRISTMAS LIGHT BULB SERIES

[76] Inventor: Fong Shi Lin, No. 196, Chin Long Road, Hsio Chin Ko Chang, Hwei Chou City, Kaunton, P.R.C., Taiwan

[21] Appl. No.: 09/198,259

[22] Filed: Nov. 24, 1998

[51] Int. Cl.[6] ..... F21V 19/06

[52] U.S. Cl. ..... 362/249; 362/396; 362/806

[58] Field of Search ..... 362/249, 252, 362/396, 806, 226, 812

[56] References Cited

U.S. PATENT DOCUMENTS 2,216,424 10/1940 Stehlin ..... 362/806
3,704,365 11/1972 Miller ..... 362/806
5,142,461 8/1992 Nugent ..... 362/252
5,317,491 5/1994 Lee ..... 362/249

*Primary Examiner*—Y. Quach
*Attorney, Agent, or Firm*—Rosenberg, Klein & Bilker

[57] ABSTRACT

The invention describes a decorative board associated with Christmas light bulb series, especially a combination of decorative boards with light bulbs having an enhanced decorative aesthetic visual effect. The decorative board according to the invention can have any proper shape or design. Arranged on the back of the decorative board are a plurality of fastening mechanisms that can easily connect with sockets of a light bulb series. With rays of light bulbs passing through the transparent decorative board, the decorative board produces a light diffusion effect and achieves decorative objects.

1 Claim, 3 Drawing Sheets

STRUCTURE OF A DECORATIVE BOARD ASSOCIATED WITH MINIATURE CHRISTMAS LIGHT BULB SERIES

BACKGROUND OF THE INVENTION

So far there is no similar product found in the market. Typically, an apparatus that adopts lighting to obtain decorative effects has a structure that directly supports light bulbs or light bulb series on a rigid fixture. Those decorative lighting apparatuses mainly use the arrangements and flickering of light to achieve a particular effect.

The present invention primarily provides an innovative design that is totally different from a conventional one in that translucent decorative boards with various profiles are used in association with illumination by indirect light sources. This concept was never suggested before.

Now the structure and features of the present invention will be described in detail with reference to the accompanying drawings.

BRIEF DESCRIPTION OF THE ACCOMPANYING DRAWINGS

DETAILED DESCRIPTION OF PREFERRED EMBODIMENTS

Figure 1:
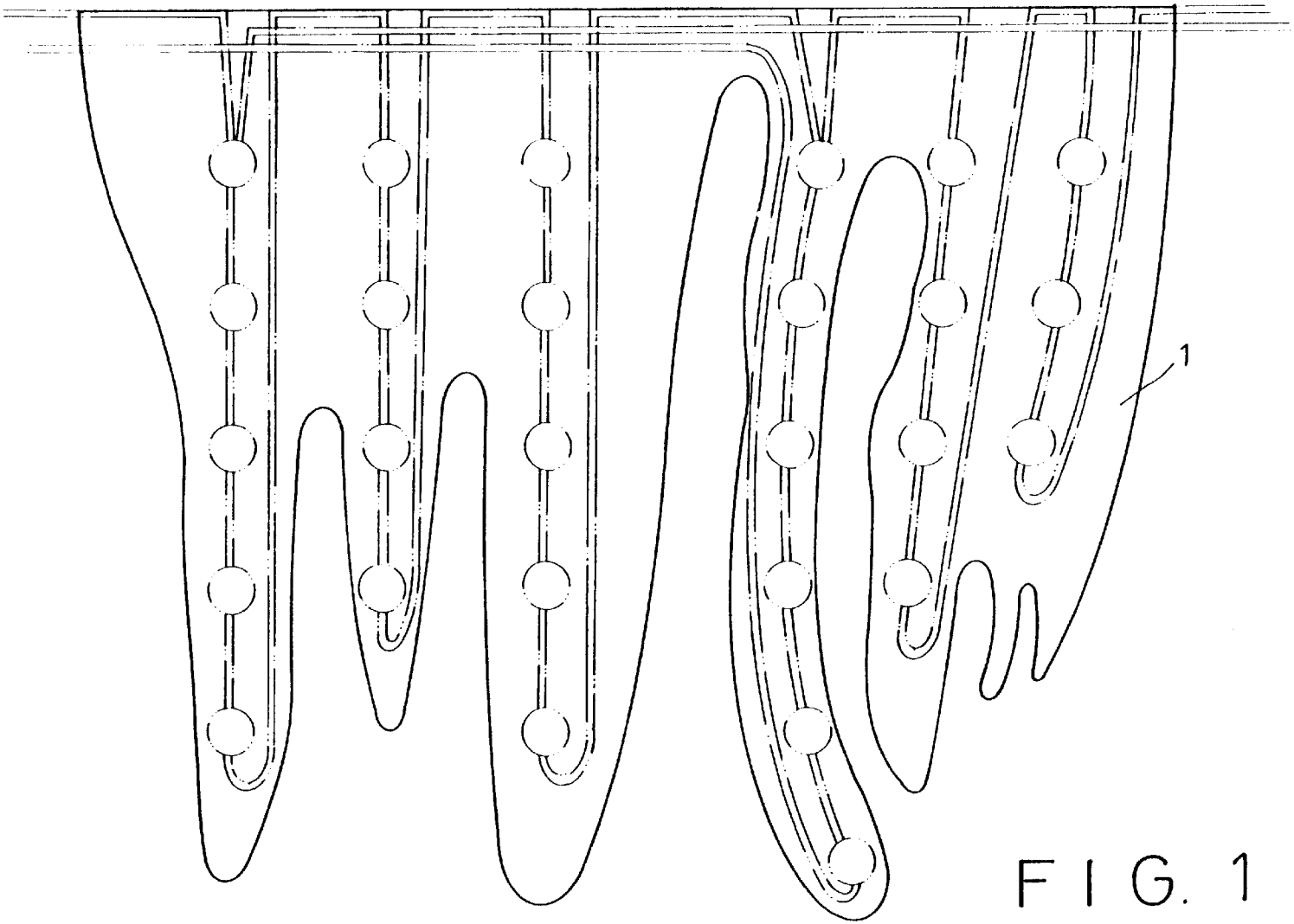
FIG. 1 is a front view showing the outer appearance of a decorative board according to the invention.
Figure 2:
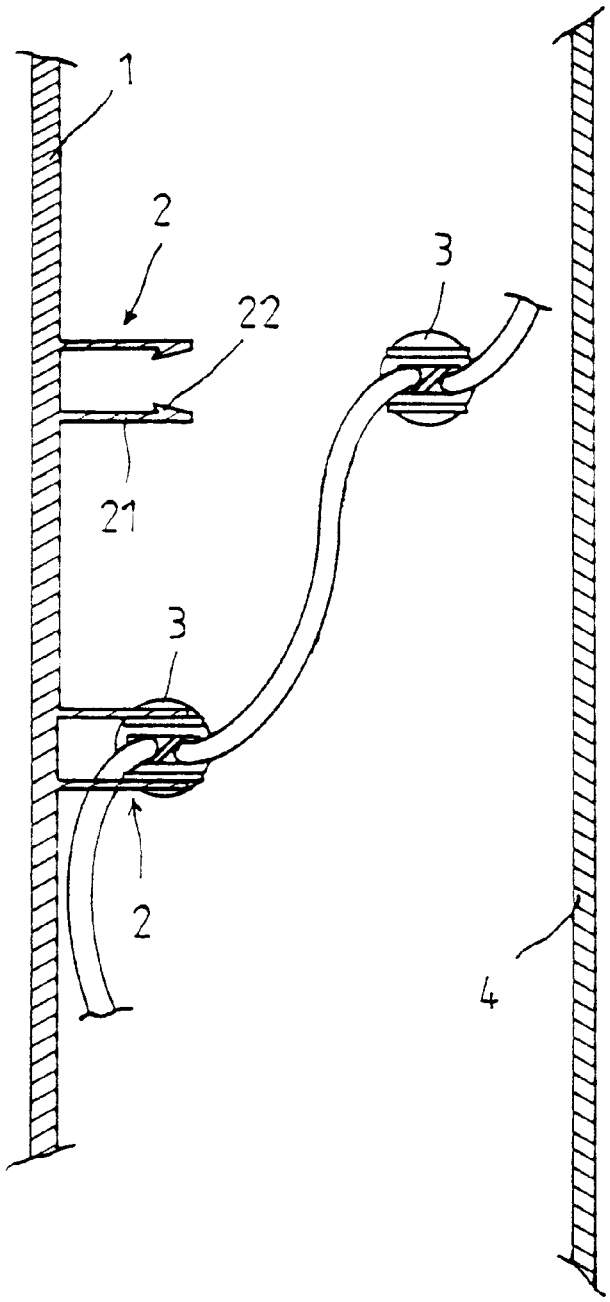
FIG. 2 is a cross sectional view schematically illustrating the fastening mechanism according to the present invention.

Referring to FIGS. 1 and 2, the decorative board structure according to the invention comprises a decorative board (1), which, in this preferred embodiment, displays a snow view. However, it also can be any transparent or semi-transparent board with a picture or design on it. For ease to understand, in the embodiment, the decorative board has a snowy shape as an illustrative example. The decorative board is made of materials that allow light rays passing through and can be hanged properly.

Figure 3:
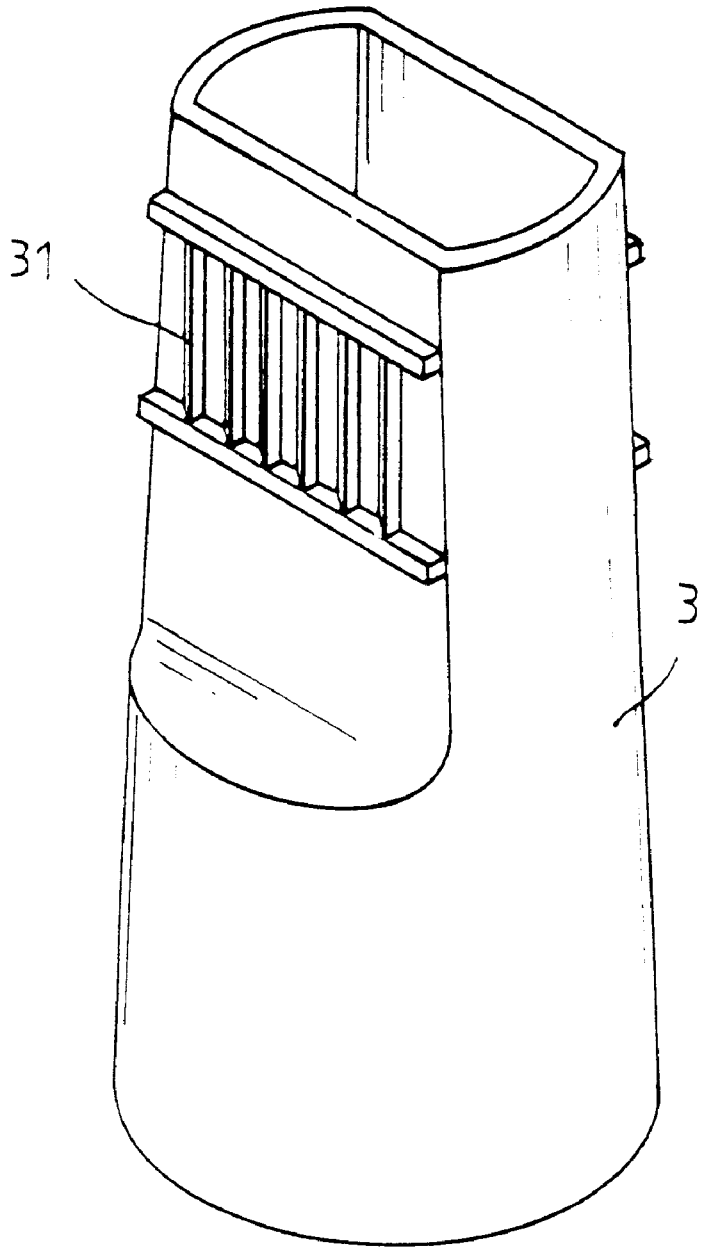
FIG. 3 is a perspective view showing the light bulb socket structure of the invention.

As shown in FIGS. 2 and 3, the decorative of the invention has on the inner wall surface a plurality of fastening mechanisms (2) that include two parallel locking arms (21) with opposite hooks (22) on the free end thereof. The fastening mechanism (2) can effectively hold a light bulb socket (3) by means of an engagement of the locking arms (21) with small parallel beams (31) formed on the outer wall surface of the socket. Thus, the sockets of a miniature light bulb series can be firmly held in position between the decorative board (1) and the wall surface (4).

In use, the light rays from a light bulb pass through the decorative board (1), resulting in an erratic dispersion and achieving soft illumination. In this embodiment, the decorative board (1) with the help of light sources arranged behind it shows imitative snow scenery. Therefore, it can obtain a maximum decorative effect.

In general, the invention can be applied to various decorative boards with different designs and light source arrangements to produce special visual effects. Such a combination of decorative boards with light bulb series has never been proposed before. However, it is very useful and valuable in the decoration industry. We hereby apply a grant of a patent.

What is claimed is:

1. A structure of a decorative Christmas light string display, comprising:

a decorative board having a predetermined contour;

a plurality of resilient fastening mechanisms coupled to one side of said decorative board, each of said resilient fastening mechanisms having a pair of locking arms disposed in spaced parallel arrangement, each of said locking arms having a hook formed on a distal end thereof; and, a plurality of light bulb sockets respectively engaged with said plurality of resilient fastening mechanisms, each of said sockets being engaged between a respective pair of said locking arms, each of said sockets having a plurality of spaced parallel beams formed on an outer wall surface thereof for locking engagement with respective hooks of a respective pair of locking arms to firmly hold said socket in position.

* * * * *